United States Patent [19]

Payne et al.

[11] 4,279,053

[45] Jul. 21, 1981

[54] TRI- OR TETRA-LOCULAR PAINT BRUSH BRISTLES

[75] Inventors: Robert H. Payne, Wilmington, Del.; Robert L. Rackley, Parkersburg, W. Va.

[73] Assignee: E. I. Du Pont de Nemours and Company, Wilmington, Del.

[21] Appl. No.: 78,044

[22] Filed: Sep. 24, 1979

[51] Int. Cl.[3] ..... A46B 15/00

[52] U.S. Cl. ..... 15/159 A; 428/398

[58] Field of Search ..... 15/159 A; 428/398

[56] References Cited

U.S. PATENT DOCUMENTS

| | | | |
|---|---|---|---|
| 2,149,425 | 3/1939 | Draemann | 18/54 |
| 2,418,492 | 4/1947 | Alfthan et al. | 18/8 |
| 2,697,009 | 12/1954 | Ingraito | 300/2 |
| 2,911,761 | 11/1959 | Anderson | 51/80 |
| 3,313,000 | 4/1967 | Hays | 18/8 |
| 3,493,549 | 2/1970 | McIntosh et al. | 161/178 |
| 3,595,952 | 7/1971 | Boyer et al. | 264/235 |
| 3,745,061 | 7/1973 | Champaneria et al. | 161/178 |
| 4,020,229 | 4/1977 | Cox | 428/398 X |

FOREIGN PATENT DOCUMENTS

| | | | |
|---|---|---|---|
| 838141 | 6/1960 | United Kingdom | 15/159 |

*Primary Examiner*—Chris K. Moore

[57] ABSTRACT

Tri- or tetra-locular oriented polymeric paintbrush bristles.

8 Claims, 3 Drawing Figures

TRI- OR TETRA-LOCULAR PAINT BRUSH BRISTLES

BACKGROUND OF THE INVENTION

Thermoplastic polymers have long been used in the preparation of brush bristles. Such bristles have been prepared in a wide variety of configurations, including solid and hollow monofilaments, and a variety of cross sectional shapes including circular, oval, triangular and lobate. These polymeric bristles have provided advantages over natural bristles such as hogs hair in both cost and performance. Polymeric bristles are often tapered to provide a large diameter end which is contained within the ferrule of the brush while presenting a smaller diameter at the tip of the paintbrush.

Polymeric paintbrush bristles are generally subjected to an abrasive treatment that results in the raising of flags on the surface of the bristle. The flags, in turn, increase the ability of the bristle to hold paint. Accordingly, efforts have been made in the past to prepare a polymeric paintbrush bristle that was particularly amenable to flagging. Other attempts at improving polymeric brush bristles have included modification of the cross-sectional configuration of the filament to reduce the tendency to curl and improve resistance to crushing of hollow filaments.

SUMMARY OF THE INVENTION

The present invention provides an improved polymeric paintbrush bristle which exhibits excellent uniformity of cross-sectional configuration, amenability to flagging, resistance to curl and overall high performance as a brush bristle.

Specifically, the instant invention provides, in a monofilamentary paintbrush bristle of thermoplastic, polymeric material having a diameter of about from 4 to 20 mils (0.10 to 0.51 mm) the improvement wherein the filament is tri- or tetra-locular and comprises three or four enclosed, longitudinal, noncircular voids, the voids being separated by an interior web, the cross-sectional area of the filament having a void content of about from 20 to 50%, and wherein the interior web comprises about from 10 to 25% of the total cross-sectional area of the filament.

DETAILED DESCRIPTION OF THE INVENTION

The brush bristles of the present invention can be prepared from a wide variety of thermoplastic polymeric materials including polyamides, polyesters and polyolefins. In general, the number average molecular weight of the polymer used for the brush bristles should be in the excess of 10,000, and preferably greater than 30,000, to provide the strength and stiffness needed in a brush bristle. Polyamides preferred for use in brush manufacturing include nylon 6,6, nylon 610, and nylon 612. Of these, nylon 610 (polyhexamethylene sebaceamide) and nylon 612 (hexamethylene diamine) are particularly preferred. Polyesters which have been found particularly well suited to bristle manufacture include polybutylene terephthalate and polyethylene terephthalate, of which polybutylene terephthalate is particularly preferred. Of the many polyolefins which can be used for bristle manufacture, polypropylene is preferred.

Figure 1:
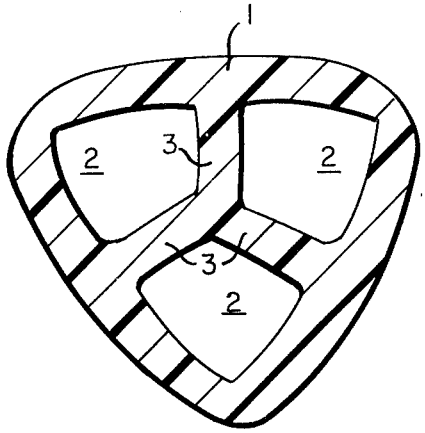
FIG. 1 is a cross-sectional illustration of a polymeric trilocular brush bristle of the present invention.

Brush bristles of the present invention comprise three or four noncircular longitudinal voids separated by an interior web. The voids are generally quadrilateral in configuration. The voids are shown in FIG. 1, which is a cross-sectional illustration of a brush filament of the present invention having three voids. There, outer wall 1 encloses the voids 2 which run longitudinal to the filament. The voids are separated by internal web 3. In general, trilocular bristles are preferred because of a more uniform exterior, configuration and better rolling characteristics.

The overall diameter, or maximum cross-sectional dimension, of the polymeric brush bristles of the present invention can be about from 4 to 20 mils. Filaments outside of this range, in general, will exhibit stiffness which is unsuitable for brush bristle applications. The bristles are generally about from 2 to 5 inches long.

The filaments of the present invention have a void content of about from 20 to 50%. The void content is determined on the basis of the weight of the hollow bristle and the weight of the solid bristle of the same exterior configuration, according to the following formula:

$$\% \text{ Void Content} = 100\left[1 - \frac{\text{weight of hollow bristle}}{\text{weight of solid bristle}}\right]$$

A void content greater than about 50% will result in undesirably low strength and cross-sectional dimensional stability, and will frequently result in splitting of the filament during processing. Void contents of less than about 20% will result in filaments with little or no improvement in flagging characteristics over solid monofilament.

The longitudinal voids result in a marked improvement in flagging ability and also result in markedly improved cross-sectional dimensional stability over monolocular hollow monofilaments of comparable diameter.

The interior webbing that separates the three or four longitudinal voids should comprise from about 10 to 25% of the total cross-sectional area of the filament. Manufacturing difficulties result with interior webs comprising less than about 10% of the cross-sectional area of the filament, while webs comprising greater than 25% of the cross-sectional area provide an overall structure which is weaker and more susceptible to bending.

The specified void content, filament diameter and web content of the filaments result in fixed dimensions for both the thickness of the outside filament wall ($t_o$), the thickness of the internal web components ($t_i$) and the outer diameter (D). These dimensions are summarized in the following Tables 1 and 2 in which the dimensions are given in mils or thousandths of an inch in Table 1 and in millimeters in Table 2.

TABLE 1

| D | $t_o$ max. | $t_o$ min. | $t_i$ max. | $t_i$ min. |
|---|---|---|---|---|
| 4 | 0.6 | 0.3 | 0.7 | 0.2 |
| 5 | 0.7 | 0.4 | 1.0 | 0.2 |
| 7 | 1.0 | 0.6 | 1.6 | 0.3 |

TABLE 1-continued

| D | $t_o$ max. | $t_o$ min. | $t_i$ max. | $t_i$ min. |
|---|---|---|---|---|
| 9 | 1.0 | 0.7 | 1.8 | 0.4 |
| 10 | 1.5 | 0.8 | 2.2 | 0.4 |
| 12 | 2.0 | 1.0 | 2.5 | 0.5 |
| 15 | 2.5 | 1.3 | 3.4 | 0.6 |
| 18 | 2.9 | 1.5 | 3.9 | 0.7 |
| 20 | 3.3 | 1.7 | 4.5 | 0.8 |

TABLE 2

| D | $t_o$ max. | $t_o$ min. | $t_i$ max. | $t_i$ min. |
|---|---|---|---|---|
| 0.102 | 0.015 | 0.0076 | 0.018 | 0.0051 |
| 0.127 | 0.018 | 0.0102 | 0.025 | 0.0051 |
| 0.178 | 0.025 | 0.0152 | 0.041 | 0.0076 |
| 0.229 | 0.025 | 0.0178 | 0.046 | 0.0102 |
| 0.254 | 0.038 | 0.0203 | 0.056 | 0.0102 |
| 0.305 | 0.051 | 0.0254 | 0.064 | 0.0127 |
| 0.381 | 0.064 | 0.0330 | 0.086 | 0.0152 |
| 0.457 | 0.074 | 0.0381 | 0.099 | 0.0178 |
| 0.508 | 0.084 | 0.0432 | 0.114 | 0.0203 |

Figure 2:
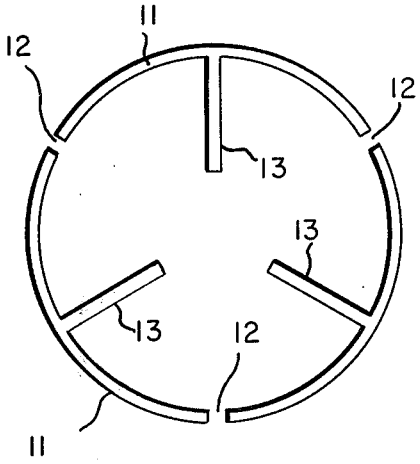
FIGS. 2 and 3 are planar illustrations of spinneret orifices which can be used to prepare the brush bristles of the present invention.
Figure 3:
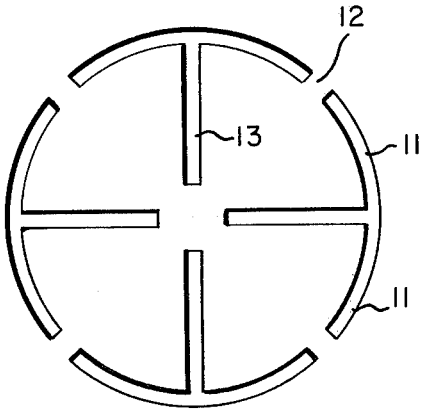

The bristles of the present invention are prepared by the extrusion of thermoplastic polymer at elevated temperatures into a filament, quenching, and then drawing the filament as described, for example, in U.S. Pat. No. 2,418,492, hereby incorporated by reference. To obtain the desired internal longitudinal voids, the polymer is extruded through a spinneret having an orifice substantially as shown in FIGS. 2 and 3, and described in U.S. Pat. No. 3,745,061. In the extrusion of a monofilament using the spinneret of FIG. 2, the exterior walls are formed by the extrusion of the thermoplastic polymer through slots 11, the spinneret plate being retained in the apparatus by support points 12. The interior web is extruded through slots 13. After passing through the spinneret, the exterior walls and the interior web fuse to form the desired complete outside cylinder and the interconnected interior webbing which defines the three interior longitudinal voids. A tetralocular filament can be formed using a spinneret orifice of FIG. 3, in which the exterior wall slots, support points and interior web slots are designated by the same numbers as in FIG. 2.

After extrusion and quenching of the polymeric monofilament, the filament is oriented by stretching to improve the longitudinal strength, generally about from 3.5 to 5 times the original length. Before quenching and orientation, the filament can, if desired, be tapered as described in the aforementioned U.S. Pat. No. 2,418,492. In general, such filaments are tapered to provide a tip diameter which is about from 0.5 to 0.75 times the diameter of the butt end. In addition, the filament can be subjected to other treatments to improve physical properties, such as treatment with saturated steam as described in U.S. Pat. No. 3,595,952, hereby incorporated by reference.

The filament is preferably heat set after drawing for good bend recovery. The heat setting can be carried out either in a gas such as by blowing hot air over the filament, or in a liquid bath such as by passing the filament through a bath of oil. The filament should remain in the heat setting stage for about from 30 to 90 seconds in a gas, or about from 2 to 10 seconds in a liquid bath. Temperatures which can be used for the heat setting operation are 150 to 200° C. when using a gas, and 140° to 200° C. when using a liquid bath.

The filaments are then cut into lengths suitable for manufacture. Tapered filaments are cut at their thick and thin portions to form individual tapered bristles.

The individual bristles are then gathered into bundles and the tip ends of the bristles tipped and flagged by conventional procedures as described, for example, in U.S. Pat. Nos. 2,697,009 and 2,911,761. The bristles can then be fabricated into brushes using techniques well known in the art.

The brush bristles of the present invention, on contact with typical flagging apparatus, produce a larger number of flags than monolocular monofilamentary bristles or solid monofilaments of the same diameter. In addition, the bristles of the present invention exhibit less tendency to curl and markedly greater resistance to crushing than unilocular monofilaments. While this reduced curl is not fully understood, it is believed to be a function of the internal voids and a uniform wall thickness. Typically the present brush bristles exhibit curl characteristics, as hereinafter described, of less than 20% in a 4-inch bristle.

The present bristles maintain a more uniformly symmetrical exterior configuration than monofilaments having a single longitudinal void. This symmetrical configuration provides ease of rolling which improves processibility of the present bristles in conventional brush manufacturing equipment. Still another advantage of the present monofilaments is an improved longevity after cleaning as compared with standard hollow filaments. The conventional single-void filaments fill with paint to a greater degree, and this paint is not readily removed during cleaning, which results in a loss of bristle flexibility with repeated use. The bristles of the present invention also resist kinking at sharper angles than monolocular monofilament bristles.

The present invention is further illustrated in the following specific example.

EXAMPLE 1

Poly(butylene -1,4-terephthalate) is extruded through a spinnerette plate as shown in FIG. 2. The polymer is extruded at a temperature of 270° C. and quenched in 25° C. water located about one inch below the spinnerette plate. The filaments are tapered using rubber pinch rolls which are operated at a cyclically varying surface speed as described in U.S. Pat. No. 2,418,492 which results in a correspondingly varying strand caliper from 16 to 24 mils. The tapered filaments are drawn at 3.75 to 4.25× with a conventional slow roll/fast roll arrangement and are heated by conventional heaters during the draw stage. The filaments are heat set by passing through a hot air oven and maintained at 170° C. to 180° C. for approximately 40 seconds.

After spinning, drawing and heat setting, the filaments are cut at each point of minimum diameter and gathered as bundles of product. Rubber bands are placed on the bundles and each two-inch diameter bundle is again center cut and ends trimmed to produce two bundles four inches long, suitable for futher processing into paintbrushes.

The filaments have a butt end caliper of 12.5 mils and a symmetrical cross-section. The outer wall thickness is 1.5 mils with internal web thickness of 1.0 mils. The tip caliper is 8.0 mils with an outer and inner wall thickness both of about 1.0 mil. The void content is about 37% and the filaments are uniform in cross-sectional configuration.

The two-inch diameter bundles are processed on a commercial tipping and flagging machine typical of those used in industry, by passing over grindstones and through rotating knives. The bundles were passed through the machine for four passes with ¼" interference between the small diameter 0.008-inch end of the bristle and the grindstones and knives.

The bristles were compared for softness with standards for bristle practice and were found to be exceptionally soft, further confirming a large number of small flags generated.

COMPARATIVE EXAMPLE A

The general procedure of Example 1 was repeated except that the spinneret plate was modified so as to omit the internal webs produced in Example 1. The resulting single-void bristles were difficult to process and exhibited a marked tendency to curl. The bristles exhibited an assymetrical, oval cross-section having a difference between the maximum and minimum caliper of 4 to 7 mils, respectively.

The filaments were examined under magnification and the number of individual flags exceeding 3/16-inch was counted. The examination of 20 samples of each of the trilocular products of the present invention and the monolocular filaments of Comparative Example A gave the following results.

| Examples | Number of Flag per Bristle | Average |
|---|---|---|
| 1 | 5–9 | 7.3 |
| A | 3–6 | 3.8 |

The brush filaments were tested for curl by examining 50-strand samples for 0.25-inch deflection or more from a line in 3.5-inch and 4.0-inch filaments. The results on two samples from each of Examples 1 and A are as follows:

| Examples | Length (inches) | % Curl |
|---|---|---|
| 1 | 4.0 | 6 |
| 1 | 3.5 | 2 |
| A | 3.5 | 40 |
| A | 3.5 | 50 |

I claim:

1. In a monofilamentary paintbrush bristle of thermoplastic polymeric material having a diameter of about from 4 to 20 mils (0.10 to 0.51 mm), the improvement wherein the filament is tri- or tetra-locular and comprises three or four enclosed, longitudinal, noncircular voids, the voids being separated by an interior web, the cross-sectional area of the filament having a void content of about from 20 to 50%, and wherein the interior web comprises about from 10 to 25% of the total cross-sectional area of the filament.

2. A brush bristle of claim 1 wherein the brush bristle is tapered to provide a tip diameter of about from 0.5 to 0.75 times the diameter of the butt end.

3. A brush bristle of claim 1 which is trilocular.

4. A brush bristle of claim 1 wherein the polymeric material consists essentially of polyamide.

5. A brush bristle of claim 4 wherein the polyamide consists essentially of nylon 612.

6. A brush bristle of claim 4 wherein the polyamide consists essentially of nylon 610.

7. A brush bristle of claim 1 wherein the polymeric material consists essentially of polybutylene terephthalate.

8. A brush bristle of claim 1 which is tipped and flagged.

* * * * *